US009273546B2

(12) United States Patent
Cartellieri et al.

(10) Patent No.: US 9,273,546 B2
(45) Date of Patent: Mar. 1, 2016

(54) APPARATUS AND METHOD FOR PROTECTING DEVICES DOWNHOLE

(75) Inventors: Ansgar Cartellieri, Celle (DE); Gunnar Bothmann, Celle (DE); Christopher Jakubeit, Celle (DE); Detlev Benedict, Nienhagen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 960 days.

(21) Appl. No.: 13/399,454

(22) Filed: Feb. 17, 2012

(65) Prior Publication Data

US 2013/0213711 A1 Aug. 22, 2013

(51) Int. Cl.
*E21B 47/017* (2012.01)
*E21B 47/01* (2012.01)
*E21B 49/08* (2006.01)

(52) U.S. Cl.
CPC ..... *E21B 47/011* (2013.01); *E21B 47/01* (2013.01); *E21B 49/08* (2013.01); *E21B 49/081* (2013.01); *E21B 49/086* (2013.01)

(58) Field of Classification Search
CPC ..... E21B 47/01; E21B 47/011; E21B 49/08; E21B 49/081; E21B 49/086
See application file for complete search history.

(56) References Cited

U.S. PATENT DOCUMENTS 4,725,995 A * 2/1988 Fowler ..... 367/149
6,325,150 B1 12/2001 Rayssiguier
6,387,314 B1 5/2002 Rohde et al.
7,367,392 B2 5/2008 Duong et al.
2005/0150655 A1* 7/2005 Duong et al. ..... 166/249
2005/0205299 A1 9/2005 Michael et al.
2006/0065395 A1 3/2006 Snell
2010/0132434 A1 6/2010 Moake
2010/0326727 A1* 12/2010 Villareal et al. ..... 175/50
2011/0316542 A1 12/2011 Frey et al.

OTHER PUBLICATIONS

Sanchez, F. Galvan, A. Cartellieri, J. Pragt, and M. Meister; "Fluid Analysis and Sampling—The Next Big Step for Logging While Drilling Tools"; SPWLA 52nd Annual Logging Symposium; Colorado Springs, CO; May 14-18, 2011.

(Continued)

*Primary Examiner* — Jennifer H Gay
*Assistant Examiner* — George Gray
(74) *Attorney, Agent, or Firm* — Mossman, Kumer & Tyler, PC

(57) ABSTRACT

An apparatus and method conducting downhole measurement operations in a borehole penetrating an earth formation. The apparatus may include a module configured to be conveyed in a borehole and to receive at least one device. The module may receive the device internally or in one or more recessed areas. A housing with at least one opening may encompass the exterior of the module. The apparatus may have a first position that allows access to the module through the at least one opening, and a second position that isolates the module from the exterior of the housing. The method may include conducting downhole measurement related operations using the apparatus. The method may include moving the housing and module between the first position and the second position.

16 Claims, 7 Drawing Sheets

(56) References Cited

OTHER PUBLICATIONS

M. Proett, D. Welshans, K. Sherril, J. Wilson, J. House, R. Shokeir, and T. Solbakk; "Formation Testing Goes Back to the Future"; SPWLA 51st Annual Logging Symposium; Perth, Australia; Jun. 2010; pp. 19-23.

S. Villareal, J. Pop, F. Bernard, K. Harms, A. Hoefel, A. Kamiya, P. Swinburne, and S. Ramshaw; "Characterization of Sampling While Drilling Operations"; IADC/SPE 128249; New Orleans, LA; Feb. 2-4, 2010.

* cited by examiner

APPARATUS AND METHOD FOR PROTECTING DEVICES DOWNHOLE

FIELD OF THE DISCLOSURE

This disclosure generally relates to exploration for hydrocarbons involving conducting measurements relating to a borehole penetrating an earth formation. More specifically, this disclosure relates to protecting downhole devices using a protective housing.

BACKGROUND OF THE DISCLOSURE

Evaluating earth formations and borehole environments may involve conveying tools for conducting measurements into the borehole environment. The borehole environment may include rough borehole wall surfaces, objects in borehole fluids, and other physical hazards. Conveyance in the borehole environment may pose a risk of physical damage to tools conveyed in the borehole environment.

Some of these tools also require access to some or part of the tool when the tool is located on the surface. For example, sampling tanks that may be filled downhole may need removal on the surface, or an energy source may need adjustment or repair. Protecting the tool from physical damage in the borehole environment often means that the protection must be removed in order to gain access to the tool on the surface. What is needed is a protective housing that allows access to the necessary parts of the tool on the surface while providing protection downhole and does not require costly and time consuming disassembly/reassembly of the protective housing to gain/restrict access.

SUMMARY OF THE DISCLOSURE

In aspects, this disclosure generally relates to exploration for hydrocarbons involving conducting measurements relating to a borehole penetrating an earth formation. More specifically, this disclosure relates to protecting measurement devices using a protective housing.

One embodiment according to the present disclosure includes an apparatus for conducting downhole measurement related operations in a borehole penetrating an earth formation, comprising: a module configured to be conveyed in the borehole and configured to receive at least one device; and a housing disposed on an exterior of the module, the housing including at least one opening, wherein the housing is configured to move between a first position that provides access to one of the at least one device from an exterior of the housing and a second position that isolates the at least one device from the exterior of the housing, and wherein the housing is in the second position when the apparatus is in the borehole.

Another embodiment according to the present disclosure includes a method of conducting downhole measurement related operations in a borehole penetrating an earth formation, comprising: conducting a downhole measurement using an apparatus comprising: a module configured to be conveyed in the borehole and configured to receive at least one device; and a housing disposed on an exterior of the module, the housing including at least one opening, wherein the housing is configured to move between a first position that provides access to one of the at least one device from an exterior of the housing and a second position that isolates the at least one device from the exterior of the housing, and wherein the housing is in the second position when the apparatus is in the borehole.

Examples of the more important features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

This disclosure generally relates to exploration for hydrocarbons involving analysis of fluids. In one aspect, this disclosure relates to protecting measurement devices downhole using a protective housing while providing access to the devices at the surface without requiring disassembly of the protective housing.

Figure 1:
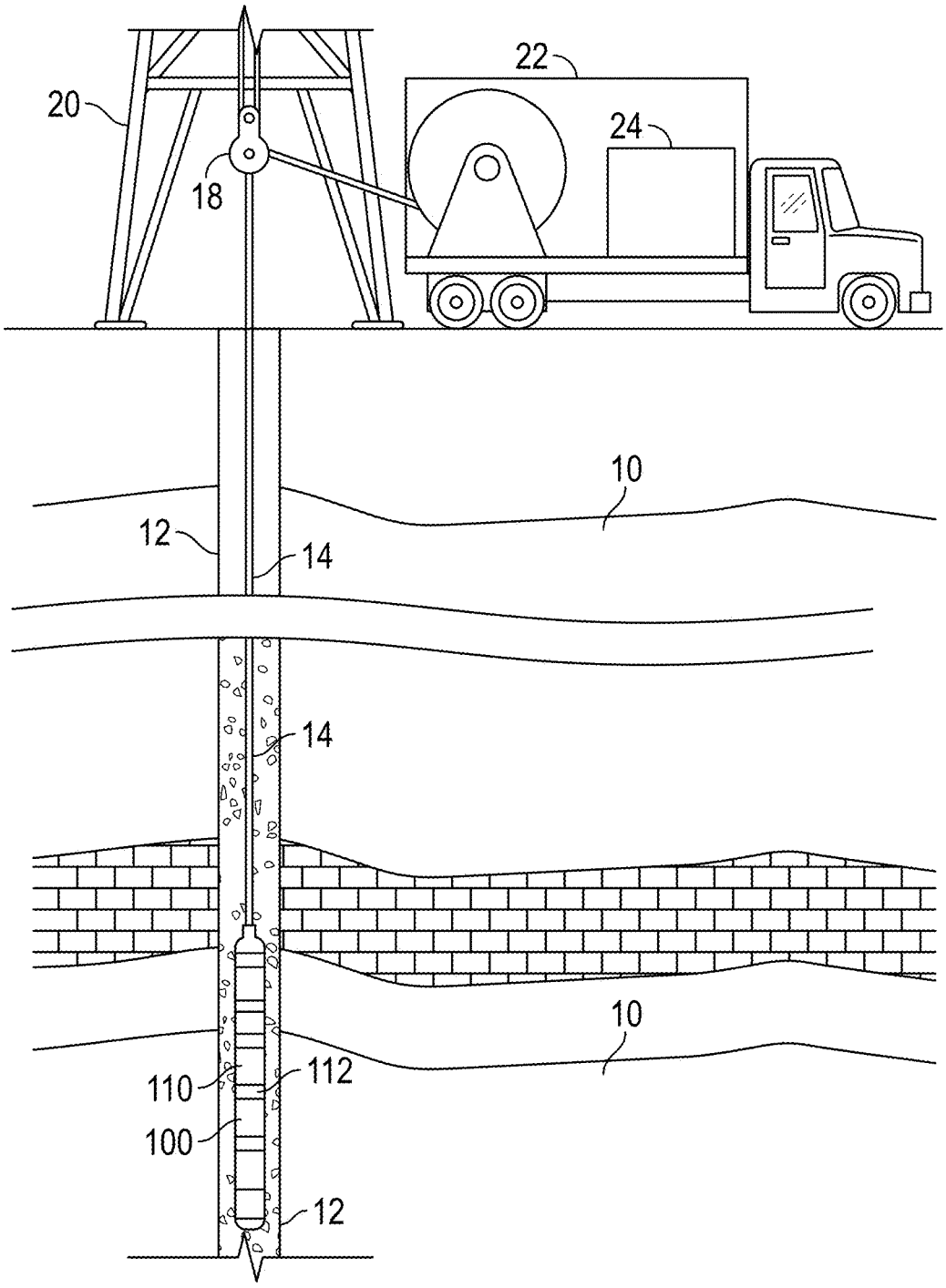
FIG. 1 shows a schematic of a module deployed in a borehole with a housing along a wireline according to one embodiment of the present disclosure.

Referring initially to FIG. 1, there is schematically represented a cross-section of a subterranean formation 10 in which is drilled a borehole 12. Suspended within the borehole 12 at the bottom end of a conveyance device such as a wireline 14 is a downhole assembly 100. The wireline 14 is often carried over a pulley 18 supported by a derrick 20. Wireline deployment and retrieval is performed by a powered winch carried by a service truck 22, for example. A control panel 24 interconnected to the downhole assembly 100 through the wireline 14 by conventional means controls transmission of electrical power, data/command signals, and also provides control over operation of the components in the downhole assembly 100. The data may be transmitted in analog or digital form. Downhole assembly 100 may include a measurement module 110. The measurement module 110 may be at least substantially enclosed by a housing 120. The housing 120 may be configured to protect the measurement module from contact with the wall of the borehole 12 and solids in the borehole 12. Herein, the downhole assembly 100 may be used in a drilling system (not shown) as well as a wireline. While a wireline conveyance system has been shown, it should be understood that embodiments of the present disclosure may be utilized in connection with tools conveyed via rigid carriers (e.g., jointed tubular or coiled tubing) as well as non-rigid carriers (e.g., wireline, slickline, e-line, etc.). Some embodiments of the present disclosure may be deployed along with LWD/MWD tools.

Figure 2:
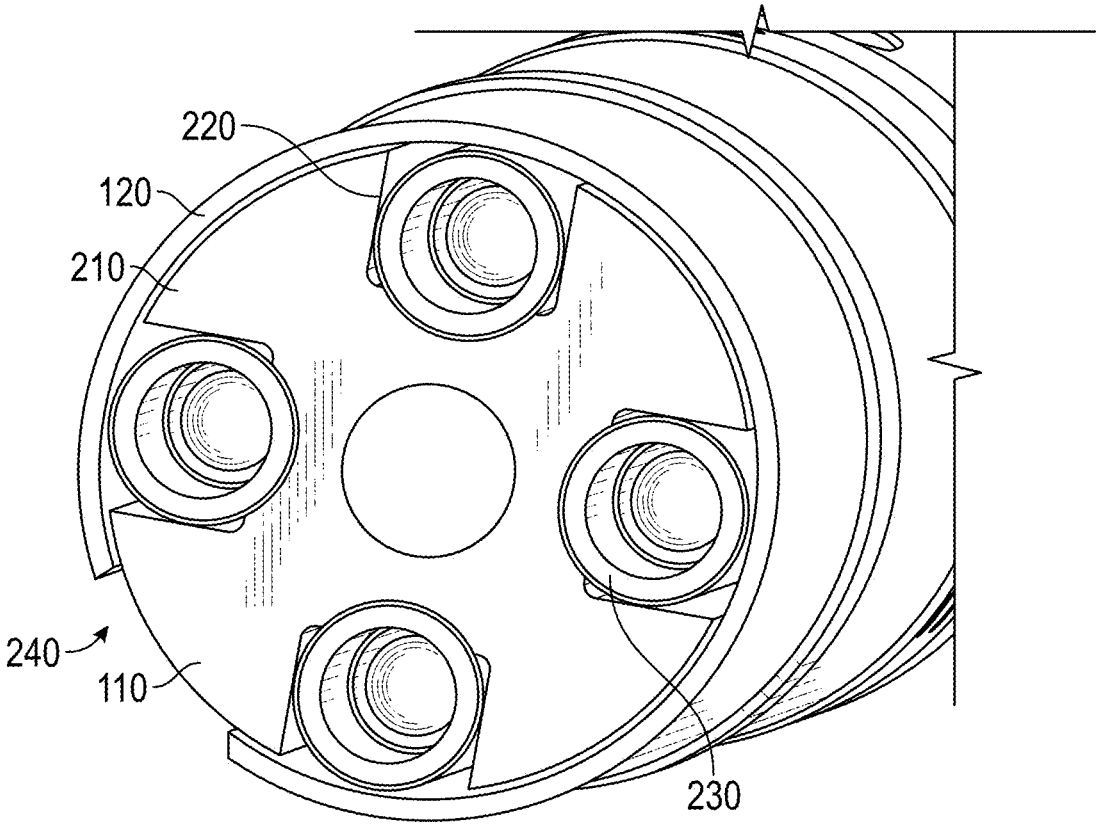
FIG. 2 shows a schematic of the housing on the module according to one embodiment of the present disclosure.

FIG. 2 shows an exemplary embodiment of measurement module 110. The measurement module 110 may be configured for at least one of: (i) performing a measurement, (ii) receiving a fluid sample, and (iii) carrying an energy source. The outer surface 210 of measurement module 110 may include one or more recessed areas 220 configured to receive devices 230 related to measurement. The devices 230 may include, but are not limited to, one or more of: (i) a fluid sample tank, (ii) a neutron source, (iii) a gamma ray source, (iv) a sensing element, (v) a dewar vessel, and (vi) a fluid supply tank. The housing 120 may include an opening 240 configured to provide access to the devices 230 when the housing 120 is in a first position relative to the module 110. The first position may be configured to provide access to one or more of the devices 230. The housing 120 may be configured to isolate the devices 230 from the borehole 12 in a second position. The second position may be configured to isolate all of the devices 230. The isolation of the second position may be such that the devices 230 are protected from damaging physical forces, but not isolated from fluidic contact with the borehole 12. The housing 120 may have an axis that may be identical or different from an axis of the module 110. The housing 120 may be configured to move relative to the module 110 in at least one of: (i) a circumferential direction, (ii) an axial direction, (iii) a helical direction, and combinations thereof.

While housing 120 is shown as generally cylindrical in shape, this is exemplary and illustrative only, as the housing may be ellipsoid or any other suitable shape as understood by one skill in the art. Housing 120 may include, but is not limited to, one or more of: (i) metal, (ii) fiber compounds, (iii) matrix composites, and (iv) sandwich materials. In some embodiments, housing 120 may include materials known to be substantially transparent to particular energy sources. For example, if device 230 includes a neutron source, the housing 120 may have a composition that is substantially non-absorbing for neutrons.

In some embodiments, one or more of the devices 230 may be disposed in an interior (not shown) of the measurement module 110. In some embodiments, the interior may be subdivided into internal sections that are physically isolated from one another.

Figure 3B:
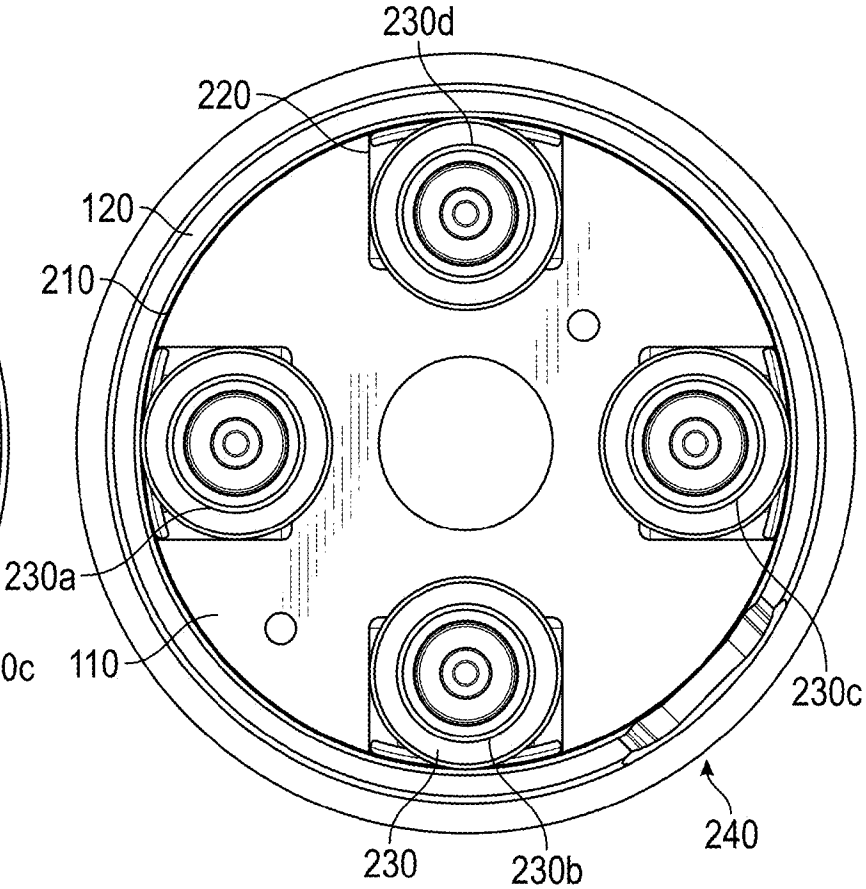
FIG. 3B shows a schematic of the housing with the opening in the second position relative to the module according to one embodiment of the present disclosure.
Figure 3A:
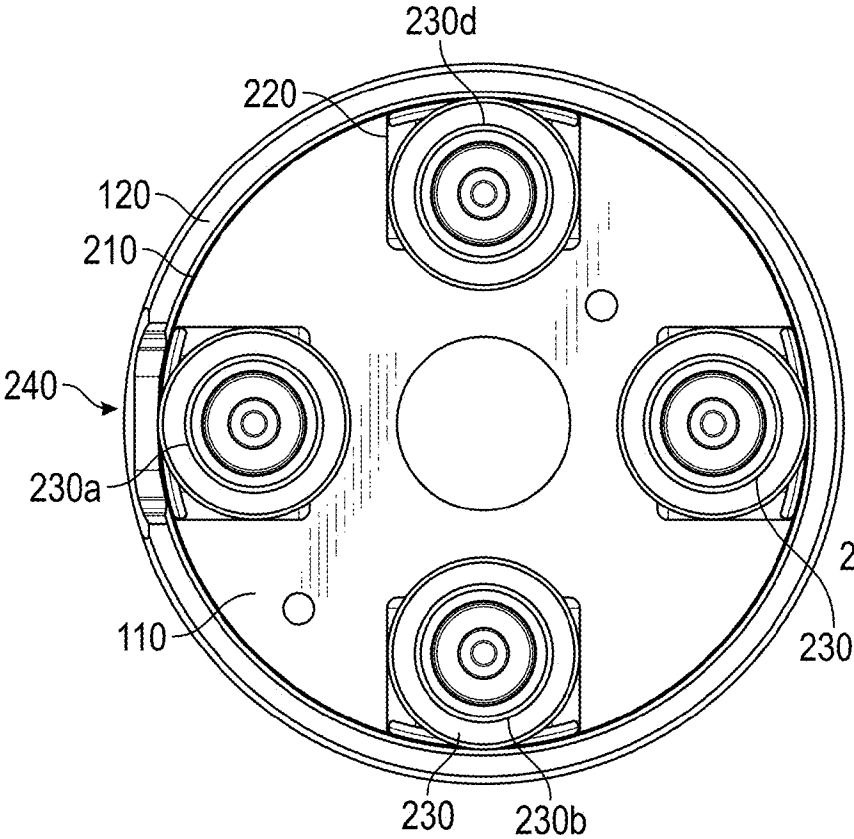
FIG. 3A shows a schematic of the housing with the opening in the first position relative to the module according to one embodiment of the present disclosure.

FIG. 3A shows an exemplary embodiment of measurement module 110 with housing 120. The housing 120 is shown in a first position where the opening 240 provides access to one of the devices 230, in this instance 230*a* of 230*a-d*. In some embodiments, devices 230*a-d* may be identical or different. There may be additional positions where access is provided to each of devices 230*b-d*. Typically, positions that grant access to the devices 230 are used when the module 110 is on the surface or otherwise at a low risk of physical damage to the devices 230. In some embodiments, housing 120 may have multiple openings 240 to allow access to more than one of the devices 230 at the same time.

FIG. 3B shows the exemplary embodiment of FIG. 3A with module 110 with housing 120 in a second position that isolates all of the devices 230 from the borehole 12. In some embodiments, housing 120 may have multiple openings 240. In some embodiments, the module 110 may have multiple recessed areas 220. In some embodiments, the number of recessed areas 220 may exceed the number of openings 240.

Figure 4:
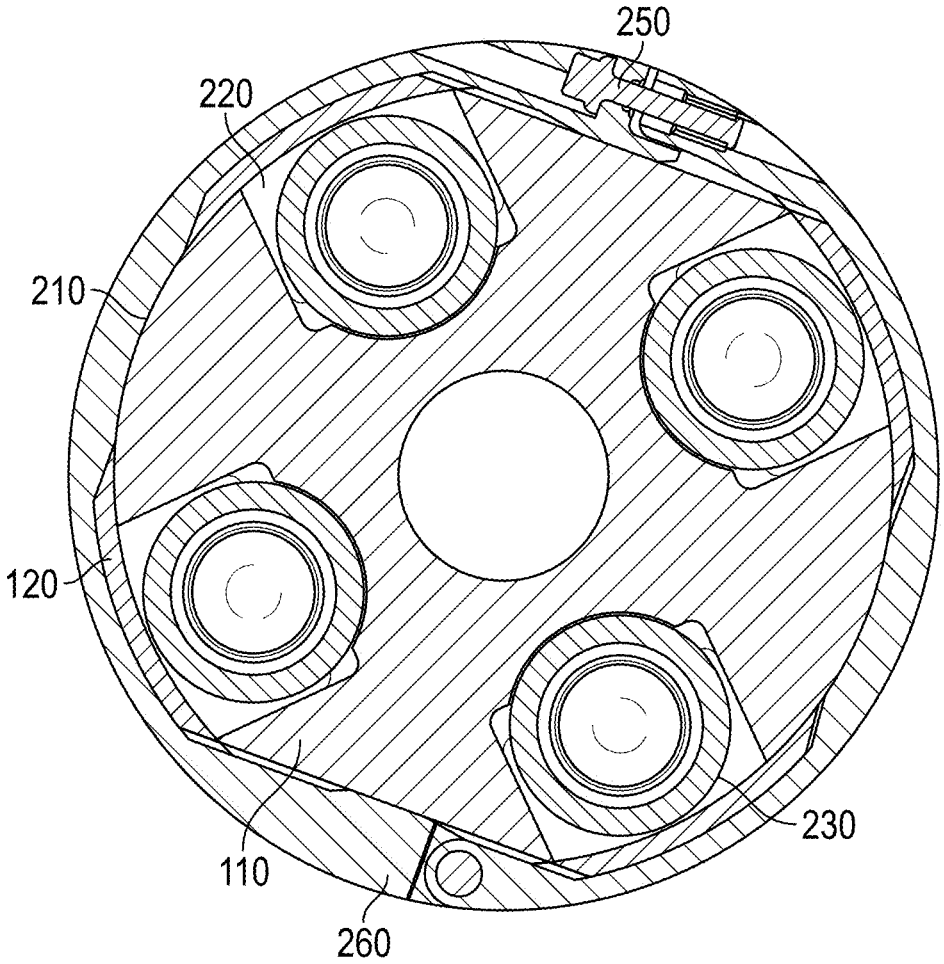
FIG. 4 shows a schematic of the housing and the module according to one embodiment of the present disclosure.

FIG. 4 shows the exemplary embodiment of FIG. 3B with a locking device 250 may be used to prevent the module 110 and housing 120 from moving from the second position. While the locking device 250 shown is with one or more bolts, this is exemplary and illustrative only, and other locking devices known to those of skill in the art may be used. In some embodiments, one or more fasteners 260 may be coupled to housing 120 to reduce the risk of buckling. Fasteners 260 may include, but are not limited to: (i) clamps, (ii) rings, and (iii) hooks.

Figure 5:
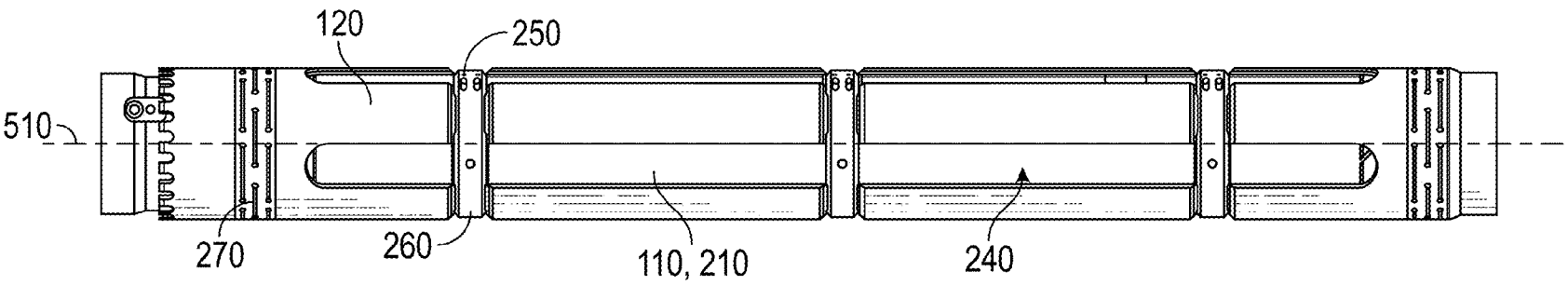
FIG. 5 shows a schematic of the housing and the module in the second position with flexible members and fasteners according to one embodiment of the present disclosure.

FIG. 5 shows an exemplary embodiment of the module 110 and housing 120 in the second position with one or more flexible members 270. Flexible member 270 may be coupled to the housing and/or disposed between the housing 120 and the module 110. Flexible members 270 may be configured to prevent separation of the housing 120 from the module 110 and/or reduce the risk of overload of the housing 120. Overload may include, but is not limited to, buckling. One exemplary flexible member 270 is a spring, but other overload protection/separation prevention devices, as understood by one of skill in the art, may be used. In this embodiment, module 110 and housing 120 have the same axis 510. In some embodiments, the module 110 and housing 120 may have different axes.

Figure 6:
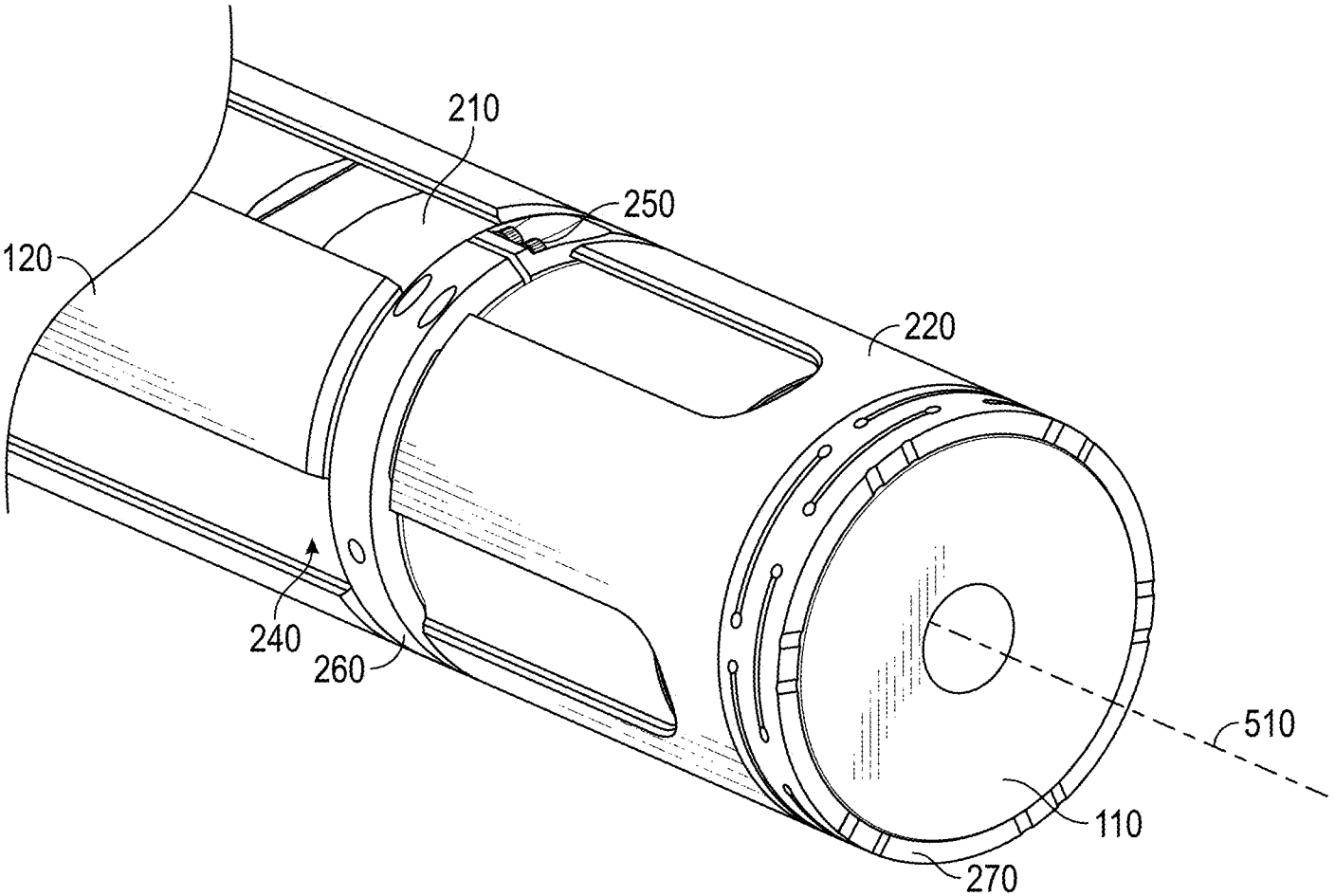
FIG. 6 shows a schematic of the housing and the module in the second position with flexible members and fasteners according to one embodiment of the present disclosure.

FIG. 6 shows a different view of the exemplary embodiment of FIG. 5. In some embodiments, housing 120 may be recess or have gaps configured to receive fastener 260 so that the surface of fastener 260 may be about flush with the surface of housing 120. Flexible members 270 are shown at the ends of housing 120 in FIGS. 5 and 6, however, this is exemplary and illustrative only, as flexible members 270 may be located in at other positions along housing 120. In some embodiments, flexible member 270 may partly or completely surround a portion of module 110.

Figure 7:
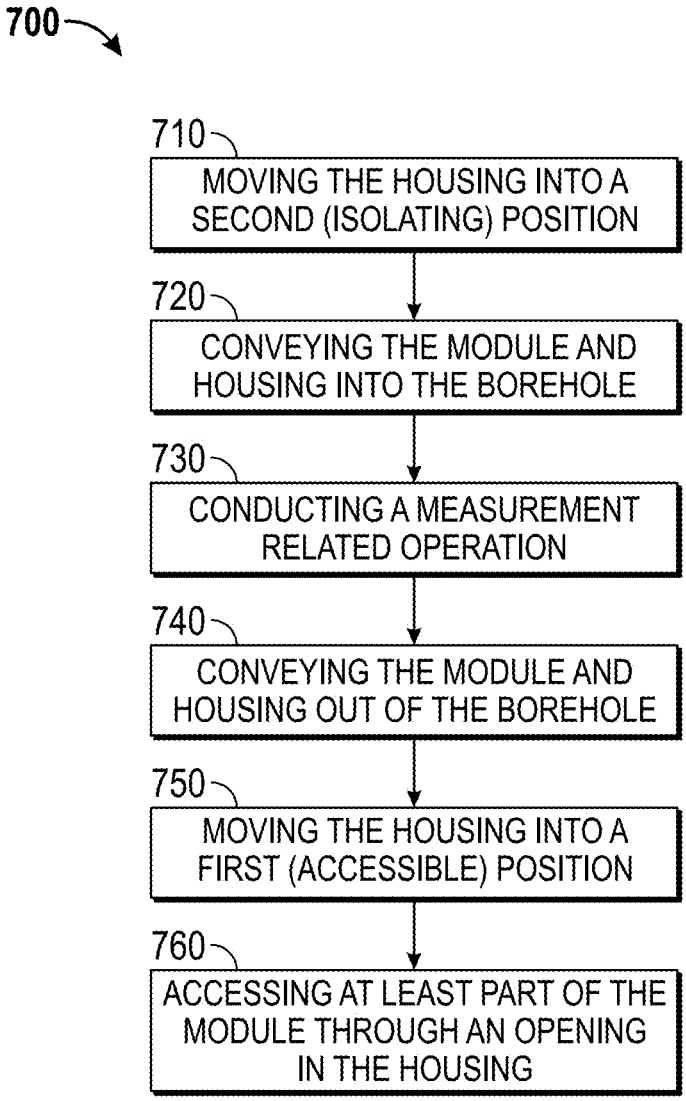
FIG. 7 shows a flow chart of a method for conducting a measurement related operation according to one embodiment of the present disclosure.

FIG. 7 shows an exemplary method 700 according to one embodiment of the present disclosure. In method 700, the housing 120 may be moved to a second position relative to the module 110 that physically isolates the devices 230 from the environment outside the housing 120 in step 710. Then, in step 720, the module 110 with housing 120 may be conveyed in borehole 12. The housing 120 may be configured to reduce damage to the module 110 due to physical contact with the wall of the borehole 12 and objects in the borehole 12. In step 730, a measurement related operation may be conducted using module 110. The measurement related operation may include, but is not limited to, at least one of: (i) performing a measurement, (ii) receiving a sample, and (iii) transmitting energy from an energy source within the module. In step 740, the module 110 and housing 120 may be conveyed out of the borehole 12. In step 750, the housing 120 may be moved to a first position relative to the module 110 that provides access to at least one of the devices 230 through at least one opening 240 in housing 120. The movement of the housing 120 from the second position to the first position may include, but is not limited to, movement in one or more of: (i) a circumferential direction and (ii) an axial direction. In step 760, at least one of the devices 230 may be accessed. For example, if the device 230 is a fluid sample tank, the access operation may include, but is not limited to, removing a sample from the fluid sample tank or removing the fluid sample tank from the module. In some embodiments, step 760 may be performed before step 710. In some embodiments, step 760 may be performed before step 710 and after step 750.

While the foregoing disclosure is directed to the one mode embodiments of the disclosure, various modifications will be apparent to those skilled in the art. It is intended that all variations be embraced by the foregoing disclosure.

What is claimed is:

1. An apparatus for conducting downhole measurement related operations in a borehole penetrating an earth formation, comprising:

a conveyance device configured for use in the borehole;

a downhole assembly connected to the conveyance device;

a module associated with the downhole assembly and configured to receive at least one device;

a housing disposed on an exterior of the module, the housing including at least one opening, the at least one device being removable from the module through the at least one opening, wherein the housing is configured to move between a first position that provides access to one of the at least one device from an exterior of the housing and a second position that isolates the at least one device from the exterior of the housing, and wherein the housing is in the second position when the apparatus is in the borehole;

a locking device surrounding the housing, the locking device including at least one fastener preventing rotational movement between the first position and the second position; and an overload protection member surrounding the housing, the overload protection member being separate from the locking device.

2. The apparatus of claim 1, wherein the module and the housing are configured to be at least one of: (i) cylindrical and (ii) ellipsoid.

3. The apparatus of claim 1, wherein the housing is configured to move relative to the module in at least one of: (i) a circumferential direction, (ii) an axial direction, and (iii) a helical direction.

4. The apparatus of claim 1, wherein the module is configured to receive the at least one device into at least one of: (i) at least one recessed portion of an outer surface of the module and (ii) an interior of the module.

5. The apparatus of claim 4, wherein the module includes a greater number of recessed portions than openings in the housing; and wherein the housing is rotatable relative to the module to selectively align the at least one opening with each of the recessed portions.

6. The apparatus of claim 1, wherein the device includes at least one of: (i) a fluid sampling tank, (ii) a nuclear source, (iii) a sensing element, (iv) a dewar vessel, and (v) a fluid supply tank.

7. The apparatus of claim 1, wherein the module and the housing are composed of at least one of: (i) the identical materials and (ii) different materials.

8. The apparatus of claim 1, wherein the housing comprises at least one of: (i) a metal, (ii) a fiber compound, (iii) a matrix composite, and (iv) a sandwich material.

9. The apparatus of claim 1, wherein the device includes a nuclear source.

10. The apparatus of claim 1, wherein the device includes a sensing element.

11. The apparatus of claim 1, wherein the housing is transparent to a selected energy source.

12. The apparatus of claim 1, wherein the housing is disposed on the module during the first and the second position.

13. The apparatus of claim 1, wherein the housing is disposed on the module during the first and the second position and rotates between the first and the second position.

14. A method of conducting downhole measurement related operations in a borehole penetrating an earth formation, comprising:

conducting a downhole measurement using a downhole assembly conveyed into the borehole, wherein the downhole assembly includes:

a module configured to receive at least one device;

a housing disposed on an exterior of the module, the housing including at least one opening, the at least one device being removable from the module through the at least one opening, wherein the housing is configured to move between a first position that provides access to one of the at least one device from an exterior of the housing and a second position that isolates the at least one device from the exterior of the housing, and wherein the housing is in the second position when the apparatus is in the borehole;

a locking device surrounding the housing, the locking device including at least one fastener preventing rotational movement between the first position and the second position; and an overload protection member surrounding the housing, the overload protection member being separate from the locking device.

15. The method of claim 14, further comprising:

moving the housing into the second position;

conveying the housing into the borehole;

conveying the housing out of the borehole;

moving the housing into the first position; and removing the at least one device through the at least one opening.

16. The method of claim 14, wherein the housing is configured to move relative to the module in at least one of: (i) a circumferential direction, (ii) an axial direction, and (iii) a helical direction.

* * * * *